US012312056B2

(12) United States Patent
Stimmel et al.

(10) Patent No.: US 12,312,056 B2
(45) Date of Patent: May 27, 2025

(54) JET PUMP ASSEMBLY AND METHOD OF SECURING JET PUMP ASSEMBLY TO PONTOON BOAT

(71) Applicant: Tennessee Propulsion Products, LLC, Orlando, FL (US)

(72) Inventors: Jason C. Stimmel, Southport, FL (US); Patricia Owens, Covington, TN (US)

(73) Assignee: TENNESSEE PROPULSION PRODUCTS, LLC, Orlando, FL (US)

( * ) Notice: Subject to any disclaimer, the term of this patent is extended or adjusted under 35 U.S.C. 154(b) by 465 days.

(21) Appl. No.: 17/856,023

(22) Filed: Jul. 1, 2022

(65) Prior Publication Data

US 2023/0182879 A1 Jun. 15, 2023

Related U.S. Application Data

(63) Continuation-in-part of application No. 17/550,365, filed on Dec. 14, 2021, now Pat. No. 11,787,520.

(51) Int. Cl.

| | |
|---|---|
| ***B63H 11/08*** | (2006.01) |
| ***B63B 1/12*** | (2006.01) |
| ***B63B 35/34*** | (2006.01) |
| ***B63H 21/14*** | (2006.01) |
| ***B63H 23/34*** | (2006.01) |

(52) U.S. Cl.

CPC ..... *B63H 11/08* (2013.01); *B63B 1/125* (2013.01); *B63B 35/34* (2013.01); *B63H 21/14* (2013.01); *B63H 23/34* (2013.01)

(58) Field of Classification Search

CPC ..... B63H 11/00; B63H 11/01; B63H 11/08; B63H 11/101; B63H 11/11; B63H 11/113; B63H 2011/081; B63H 1/125; B63H 20/02; B63H 21/14; B63H 21/30; B63H 23/34; B63H 35/34

USPC ..... 114/38, 46, 292

See application file for complete search history.

(56) References Cited

U.S. PATENT DOCUMENTS

| | | | | |
|---|---|---|---|---|
| 4,942,838 | A | 7/1990 | Boyer et al. | |
| 4,964,821 | A | 10/1990 | Tafoya | |
| 6,267,633 | B1 * | 7/2001 | Suganuma | B63H 11/11 440/41 |
| 6,406,339 | B1 * | 6/2002 | Sills | B63H 11/107 440/38 |
| 7,182,033 | B1 | 2/2007 | Phillips et al. | |
| 7,185,599 | B1 | 3/2007 | Griffiths et al. | |
| 8,480,444 | B2 | 7/2013 | Mataya | |
| 10,486,786 | B1 | 11/2019 | Kimball | |
| 10,787,237 | B2 | 9/2020 | Kimball | |

(Continued)

FOREIGN PATENT DOCUMENTS

WO 2016147102 A2 9/2016

*Primary Examiner* — Daniel V Venne

(74) *Attorney, Agent, or Firm* — Allen, Dyer, Doppelt + Gilchrist, PA

(57) ABSTRACT

A jet pump assembly includes a marine engine, a jet drive and a shield adapted to be secured to a transom of a watercraft. The shield has arms to which the marine engine is secured and legs to which an intake mount is secured. The jet drive is supported by the intake mount. The shield has at least one flange adapted to be secured to a middle toon of a pontoon boat. The shield covers an opening in the middle toon through which the marine engine is passed during assembly. A gasket between the shield and opening prevents water from entering the middle toon.

20 Claims, 15 Drawing Sheets

(56) References Cited

U.S. PATENT DOCUMENTS

| | | | |
|---|---|---|---|
| 10,933,965 | B2 | 3/2021 | Kimball |
| 2006/0228959 | A1 | 10/2006 | Ruiz |
| 2007/0283869 | A1 | 12/2007 | Quinn |
| 2020/0369357 | A1 | 11/2020 | Kimball |
| 2021/0147055 | A1 | 5/2021 | Kimball et al. |

* cited by examiner

JET PUMP ASSEMBLY AND METHOD OF SECURING JET PUMP ASSEMBLY TO PONTOON BOAT

CROSS-REFERENCE TO RELATED APPLICATIONS

This application is a Continuation-In-Part of U.S. patent application Ser. No. 17/550,365 filed Dec. 14, 2021 (now U.S. Pat. No. 11,787,520), the disclosure of which is incorporated by reference herein.

TECHNICAL FIELD

The present invention relates generally to jet pumps for watercraft, and more particularly, to a jet pump assembly for watercraft having a compact modular "plug and play" configuration for installation through a portion of the watercraft with a substantial portion of the jet pump assembly configured to be positioned external to the watercraft.

BACKGROUND

Jet pumps for watercraft such as motorboats typically require multiple hours to completely install the jet pump in the hull of the motorboat along with an engine for powering the jet pump and a separate exhaust system for directing exhaust from the engine to an exterior of the motorboat. For example, it may take between approximately 5 and 7 hours for a technician to complete such an installation. In addition, the technician is typically required to drill a large quantity of holes through the hull of the boat to accommodate various components of the jet pump and the exhaust system. In one example, approximately 67 holes and fasteners may be needed. In addition to contributing to the amount of time required to complete installation, each hole through the hull creates an undesirable opportunity for leakages to occur during use of the motorboat.

Leaking and alignment issues are also known to occur at or near the interface between the jet pump and the hull of the motorboat.

Undesirable vibrations are also frequently transferred between the jet pump and the hull of the motorboat and may result in damage to components and/or cargo of the motorboat, and/or discomfort to passengers of the motorboat.

Moreover, conventional jet pumps are typically configured for use in a single size or class of watercraft, such that a jet pump configured for use in a watercraft of a first size may not be compatible with a watercraft of a second size.

Accordingly, there is a need for a jet pump assembly for use in a watercraft that overcomes these and other deficiencies of conventional jet pumps.

There is further a need for a jet pump assembly that may be quickly and easily installed in a watercraft such as a pontoon boat.

There is further a need for a method of installation of a jet pump assembly in a watercraft such as a pontoon boat that is quick and easy.

SUMMARY

According to an exemplary embodiment of the invention, a jet pump assembly for attachment to a middle pontoon of a pontoon boat includes three principal components: a marine engine, a jet drive including a rotatable shaft configured to receive torque from the marine engine and a shield adapted to be secured to the middle pontoon of the pontoon boat. The jet pump assembly may be quickly and easily assembled outside the pontoon boat before being secured to the middle pontoon of the pontoon boat.

In one embodiment, the shield is a unitary member having two parallel arms to which the marine engine is secured, either directly or indirectly, and two parallel legs to which a generally U-shaped intake mount is secured. The jet drive is secured to the intake mount, either directly or indirectly. The shield may have a removable or hinged cover to allow a person to access inside a hollow interior of the shield without having to remove the shield from the middle pontoon of the pontoon boat. The shield is secured to a portion of the middle pontoon of the pontoon boat such that the parallel legs and central portion of the shield are behind the middle pontoon of the pontoon boat. The two parallel arms of the shield extend forwardly from the central portion of the shield in a direction opposite the direction of the legs of the shield. The shield has a flange extending around its perimeter which has spaced openings. The openings in the flange of the shield are sized to receive fasteners which secure the shield to a rear portion or flange of the middle pontoon of the pontoon boat. In some embodiments, two parallel hollow legs of the shield extend in an opposite direction from two parallel hollow arms of the shield. However, the shield may have any other number of legs and/or arms to assist in the securement or positioning of the marine engine or jet drive. The legs and/or arms may be partially or fully hollow. The shield is large enough to cover an opening in the middle pontoon of the pontoon boat. The opening in the middle pontoon of the pontoon boat is sized so that a portion of the marine engine may pass though the opening in the middle pontoon of the pontoon boat.

The middle pontoon of the pontoon boat has an opening on the rear side of a rectangular cavity large enough so that the marine engine of the jet pump assembly may pass through the opening prior to installation of the assembled jet pump assembly. The rectangular cavity is sized to receive and retain the marine engine. The opening in the middle pontoon of the pontoon boat is sized to allow the marine engine to pass through the opening prior to the shield of the jet pump assembly being secured to the rear portion or flange of the middle pontoon of the pontoon boat. The shield is large enough to cover the opening in the middle pontoon of the pontoon boat and prevent water from entering the rectangular cavity of the middle pontoon. The rectangular cavity may have an open top which may be covered by a pontoon boat manufacturer.

The middle pontoon of the pontoon boat has a ramp which functions to direct water into a water inlet of the jet drive while the middle pontoon is moving along with the pontoon boat. The ramp is generally planar or flat so air does not enter the water inlet of the jet drive while the middle pontoon is moving along with the pontoon boat.

According to another aspect of the invention, the jet pump assembly comprises a marine engine, a jet drive including a rotatable shaft configured to receive torque from the marine engine and a shield secured to the middle pontoon of a pontoon boat. The shield has two hollow parallel legs by which the jet drive is supported. The shield has two hollow parallel arms by which the marine engine is supported. The rotatable shaft of the jet drive extends through an opening in the shield. The shield covers an opening in the middle pontoon of the pontoon boat.

The opening in the middle pontoon of the pontoon boat is large enough to allow the marine engine of the jet pump assembly to be passed through the opening in the middle pontoon of the pontoon boat before the shield is secured to the rear portion or flange of the middle pontoon of the pontoon boat, thereby creating a waterproof seal around the opening in the middle pontoon of the pontoon boat. The shield has a flange around the perimeter which is adapted to be secured to a rear portion or flange of the middle pontoon of the pontoon boat after at least a portion of the marine engine is passed though the opening in the middle pontoon of the pontoon boat. The shield is located behind the middle pontoon of the pontoon boat and covers the opening in the middle pontoon of the pontoon boat, thereby preventing water from entering the interior of the middle pontoon of the pontoon boat through the opening in the middle pontoon of the pontoon boat.

The combination of watercraft and jet pump assembly may further include at least one gasket configured to be positioned between the rear portion or flange of the middle pontoon of the pontoon boat and a flange of the shield. The at least one gasket or vibration isolator may be made of any known material such as rubber to dampen vibrations caused by the marine engine.

According to yet another aspect of the invention, a method of installing a jet pump assembly to a middle pontoon of a pontoon boat comprises securing a jet drive and a marine engine to a shield to create the jet pump assembly. A portion of the jet drive extends through an opening in the shield and is secured to the marine engine so the marine engine may power the jet drive. The marine engine and jet drive may be coupled together outside the watercraft, thereby making assembly and installation of the jet pump assembly more simple and easier than heretofore known.

After the jet pump assembly is fully assembled, the marine engine of the jet pump assembly is passed at least partially through the opening in the middle pontoon of the pontoon boat until a gasket is sandwiched between one or more flanges of the shield and a rear portion or flange of the middle pontoon of the pontoon boat. Fasteners are used to secure the shield of the jet pump assembly to the rear portion or flange of the middle pontoon of the pontoon boat. The shield and gasket prevent water from entering the middle pontoon of the pontoon boat through the opening in the middle pontoon of the pontoon boat.

In assembling the jet pump assembly, the jet drive is secured to an intake mount which is secured to two hollow, parallel legs of the shield and the marine engine is secured to two hollow, parallel arms of the shield.

According to yet another aspect of the invention, a method of installing a jet pump assembly to a middle pontoon of the pontoon boat comprises building a jet pump assembly by securing an intake mount and a marine engine to a shield. A jet drive is supported by the intake mount which is typically U-shaped. The shield has an opening through which a portion of the jet drive extends. The marine engine is coupled to the jet drive to power the jet drive. The method further comprises passing a portion of the jet pump assembly through an opening in the middle pontoon of the pontoon boat and securing the shield to the middle pontoon of the pontoon boat. The portion of the jet pump assembly which is passed through the opening in the middle pontoon of the pontoon boat comprises at least a portion of the marine engine. The shield has a flange which is the part of the shield which is secured to a rear portion or flange of the middle pontoon of the pontoon boat with spaced fasteners. A gasket is sandwiched between the rear portion or flange of the middle pontoon of the pontoon boat and the flange of the shield to prevent water from leaking inside the shield and into the middle pontoon of the pontoon boat. In assembling the jet pump assembly, the jet drive is supported by two hollow parallel legs of the shield and the marine engine is supported by two hollow parallel arms of the shield.

The jet pump assembly of the present invention when installed on a middle pontoon of the pontoon boat allows easy access to the jet drive for service from outside the pontoon boat.

Another advantage of the jet pump assembly of the present invention is that a marine engine manufacturer may fully assemble the jet pump assembly without having to rely on a boat manufacturer to install the marine engine and jet pump or jet drive separately.

Another advantage of the jet pump assembly of the present invention is a boat manufacturer does not need to construct a special or custom hull to support a particular jet drive.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The drawings, which are incorporated in and constitute a part of this specification, illustrate embodiments of the invention and, together with the general description given above and the detailed description given below, explain the embodiments of the invention.

DETAILED DESCRIPTION

Figure 1:
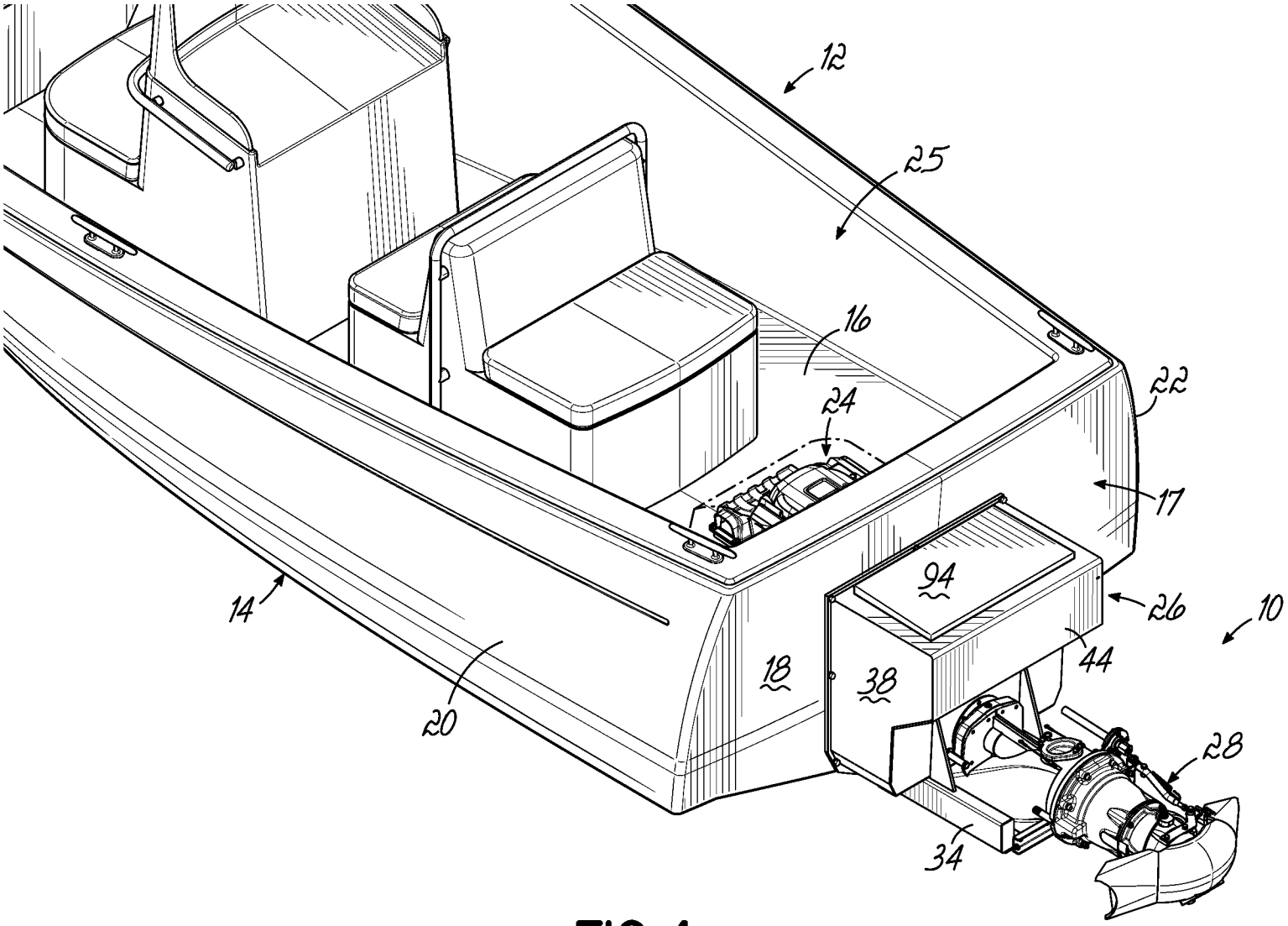
FIG. 1 is a perspective view of a watercraft including an exemplary jet pump assembly in accordance with the invention.

Referring now to FIG. 1, an exemplary jet pump assembly 10 according to an aspect of the invention is shown mounted to a watercraft 12. The watercraft 12 includes a hull 14 which has a bottom 16, a bow (not shown), a stern 17, a transom 18, a port side 20, and a starboard side 22, which collectively define an interior 25 of the watercraft. The jet pump assembly 10 may be operatively coupled to a transom 18 of the hull 14 as shown in FIG. 1 for supplying power to the jet pump assembly 10 to propel the watercraft 12 through the water.

As discussed in greater detail below, the jet pump assembly 10 may have a compact modular "plug and play" configuration for installation onto the transom 18 of the watercraft 12 with a substantial portion of the jet pump assembly 10 positioned external to the hull 14. The features of the jet pump assembly 10 are set forth in further detail below to clarify each of these functional advantages and other benefits provided in this disclosure.

Figure 4:
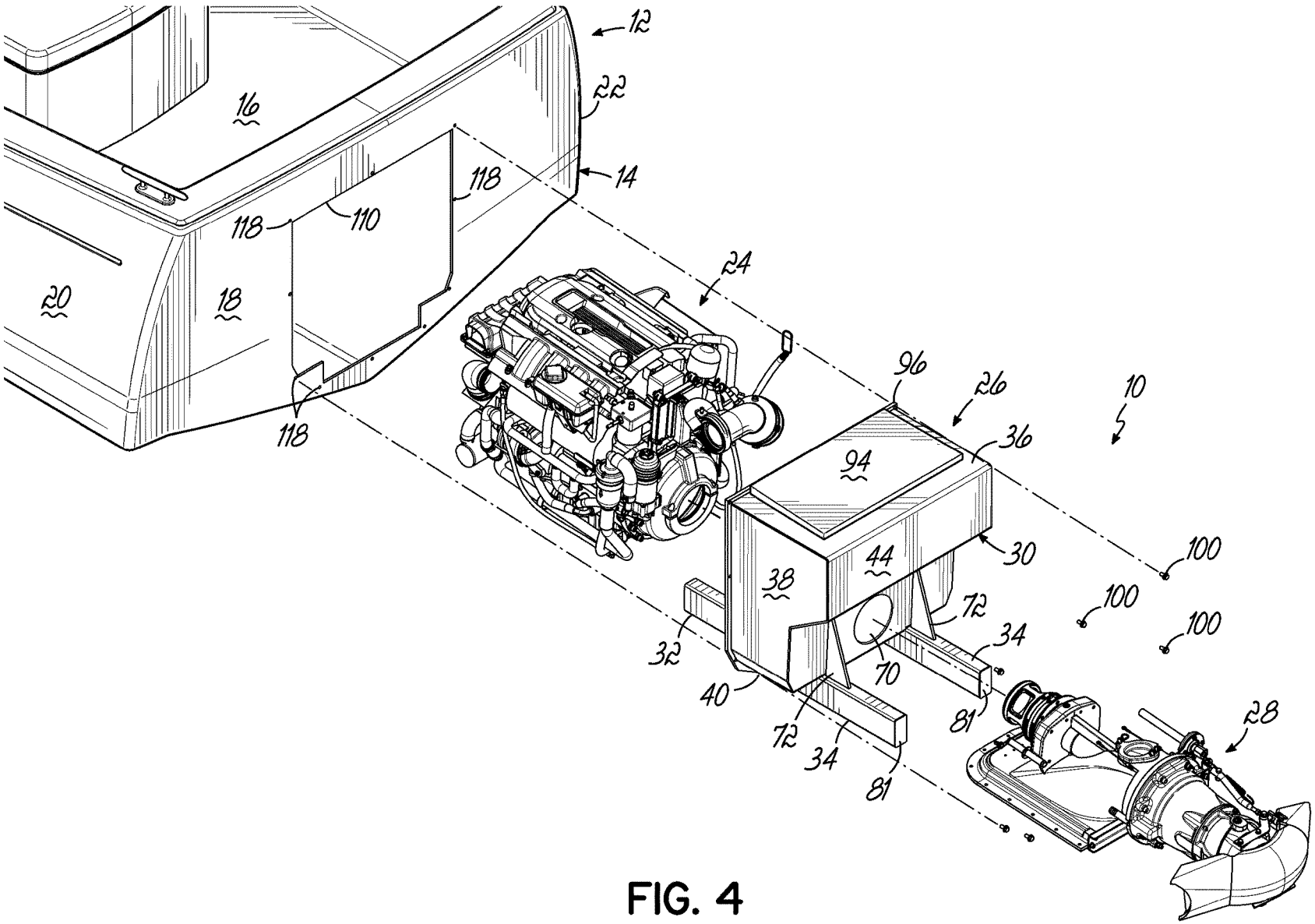
FIG. 4 is a perspective view of the jet pump assembly prior to assembly.

As best shown in FIG. 4, the jet pump assembly 10 comprises a marine engine 24, a shield 26 and a jet drive 28. Although one configuration of marine engine 24 is illustrated, any known marine engine may be used. The drawings are not intended to be limiting. Similarly, although one configuration of jet drive 28 is illustrated, any known jet drive may be used. Exemplary jet drives are disclosed in U.S. Pat. Nos. 10,486,786 and 10,787,237 which are fully incorporated herein.

Figure 6:
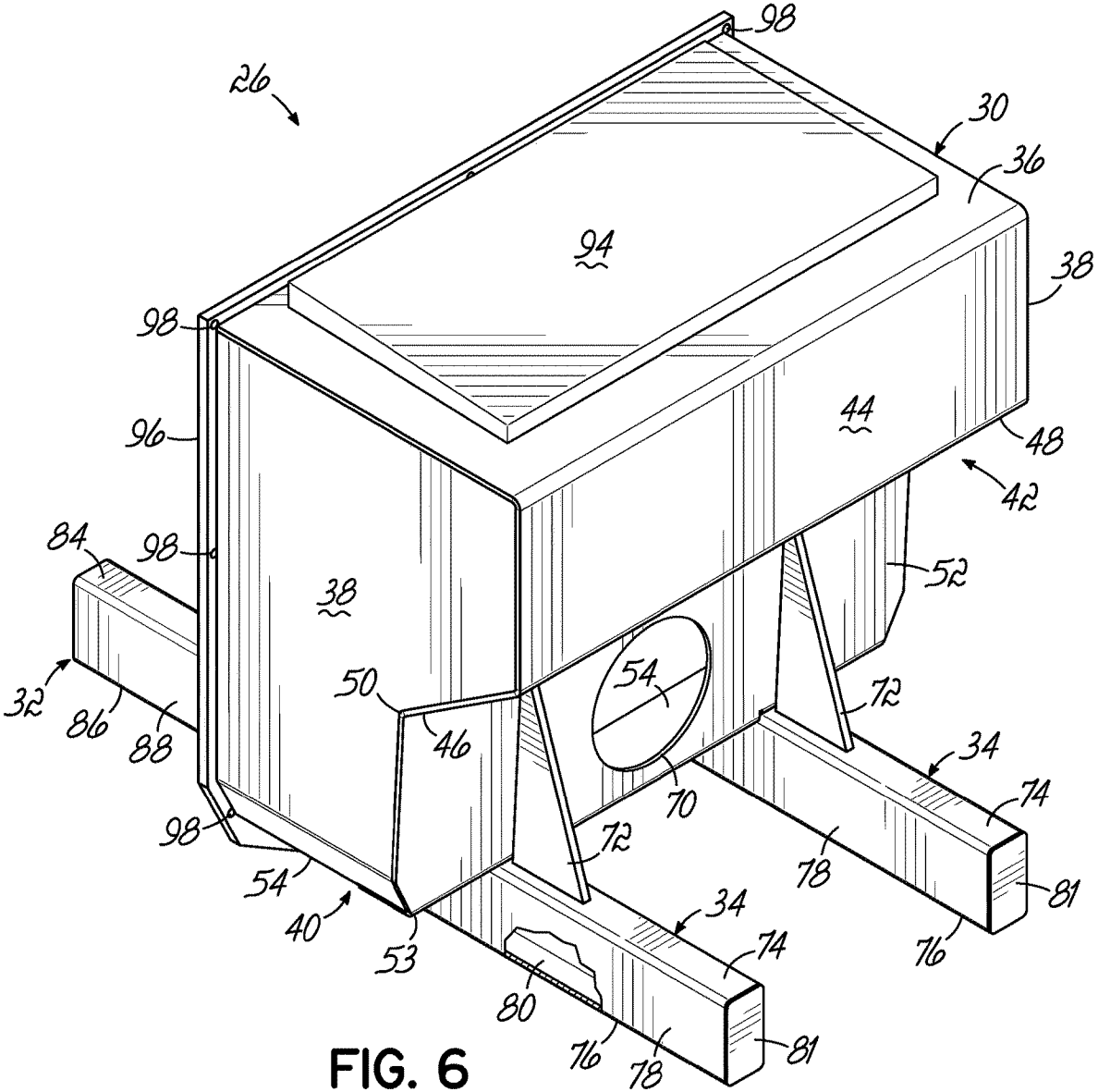
FIG. 6 is a rear perspective view of the shield of the jet pump assembly.
Figure 7:
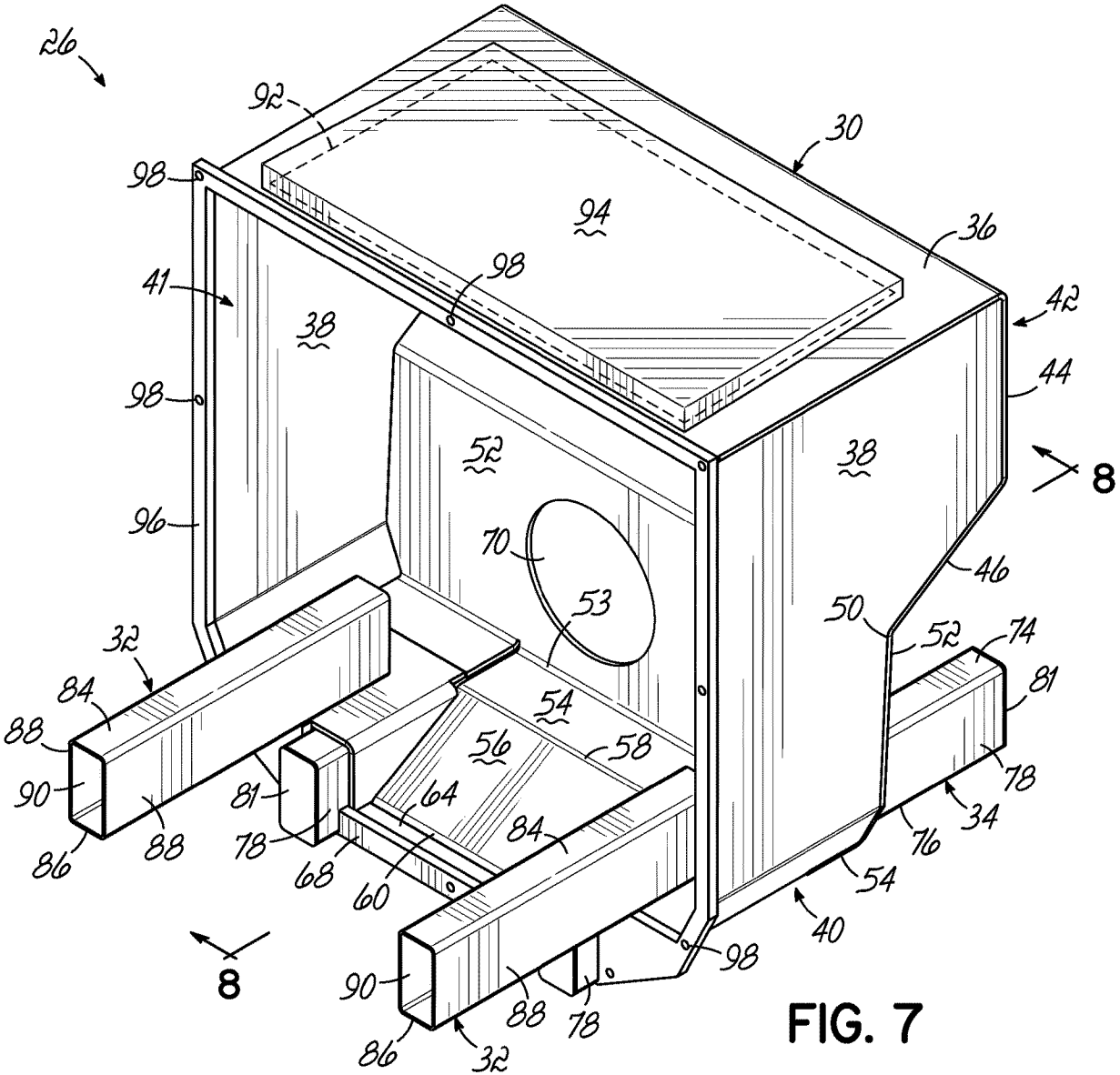
FIG. 7 is a front perspective view of the shield of the jet pump assembly.
Figure 8:
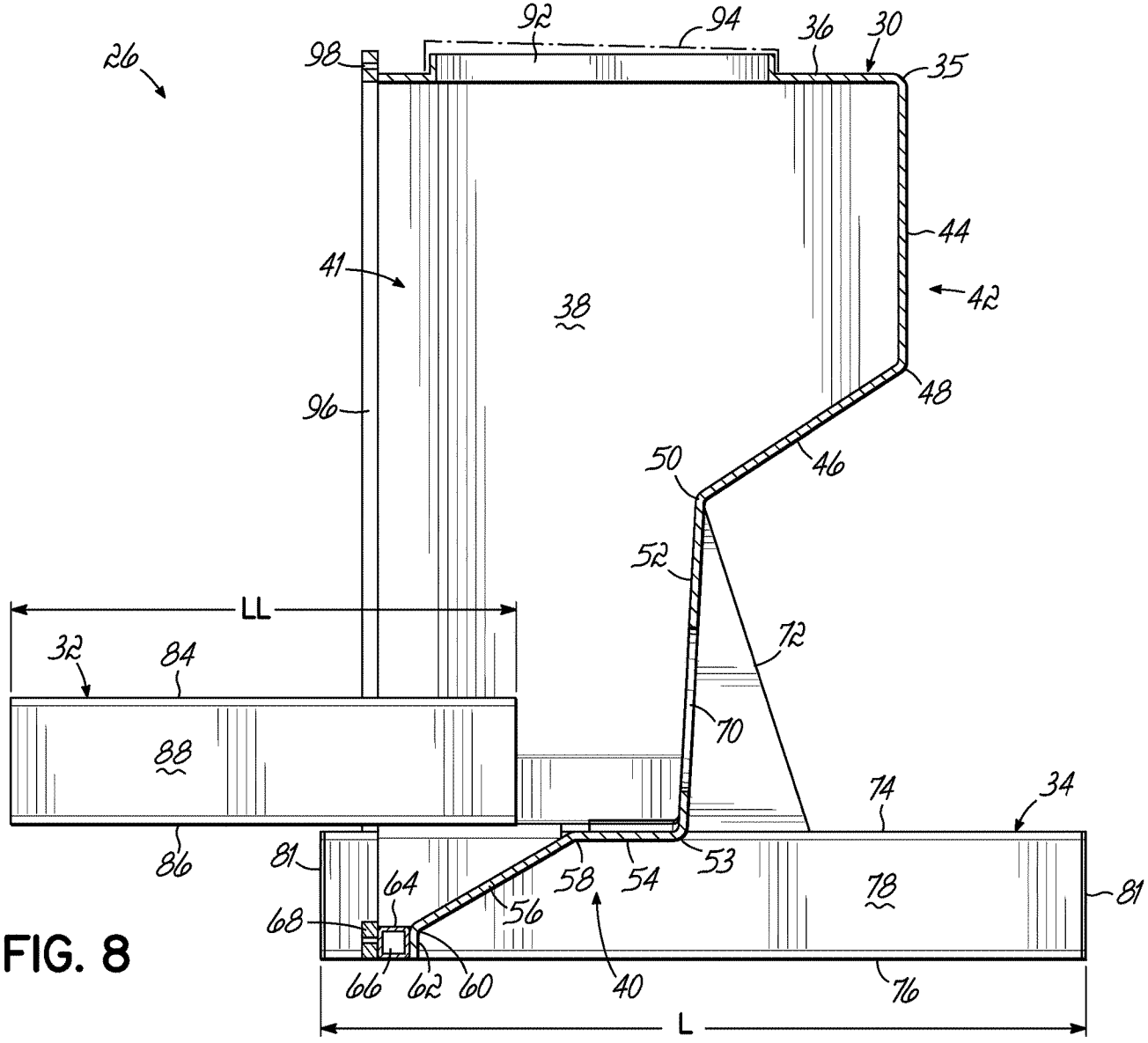
FIG. 8 is a side view of the shield of the jet pump assembly.

As best illustrated in FIGS. 6-8, one embodiment of shield 26 of the jet pump assembly 10 comprises a central portion 30, two arms 32 extending forwardly from the central portion 30 and two legs 34 extending rearwardly from the central portion 30. The central portion 30 of shield 26 includes a top 36, two sides 38, a bottom 40 and a rear 42 which define a hollow interior 41.

As best shown in FIG. 8, the top 36 of the shield 26 is bent downwardly along bend 35 to make the rear 42 of the shield 26. The rear 42 of the shield 26 has an upper portion 44 which is generally vertically oriented, a middle portion 46 which is sloped or inclined downwardly from bend 48 to bend 50, and a lower portion 52. The lower portion 52 of rear 42 of the shield 26 is slightly sloped or declined from bend 50 to bend 53. As best shown in FIGS. 6 and 7, a circular opening 70 is cut from the lower portion 52 of the rear 42 of the shield 26.

As best shown in FIGS. 7 and 8, the bottom 40 of the shield 26 has a front portion 54, a sloped portion 56 and a stub portion 62. The front portion 54 is generally horizontally oriented in the drawings extending from bend 53 to bend 58. The sloped portion 56 extends downwardly and forwardly from bend 58 to bend 60. As best shown in 8, from bend 60, the stub portion 62 is generally vertically oriented in the drawings.

A stabilizer 64 having a hollow interior 66 is secured to the stub portion 62 of the bottom 40 of the shield 26. As best shown in FIG. 8, a bracket 68 is secured to the stabilizer 64.

As best shown in FIG. 8, the top 36 and bottom 40 of the shield 26 are illustrated as being made from the same piece of metal as the rear 42 of the shield 26. However, the top and/or bottom 40 of the shield 26 may be made from one or more different pieces of metal than the rear 42 of the shield 26. The portions of the shield including the sides 38 of the shield 26 may be made of any number of different pieces.

As best shown in FIG. 6, each leg 34 of the shield 26 is secured to the lower portion 52 of the rear 42 of the shield 30 with a triangular wedge 72 for stability and strength. Each wedge 72 is welded to the lower portion 52 of the rear 42 of the shield 26 and to an upper wall 74 of one of the legs 34 of the shield 26. As best shown in FIG. 6, each leg 34 of the shield 26 has an upper wall 74, a bottom wall 76 and two side walls 78 which define a hollow interior 80 and define a rectangular cross-sectional configuration. Each end of each leg 34 of the shield 26 has a cap 81 to prevent water from entering the hollow interior 80 of the leg 34 of the shield 26.

As best shown in FIG. 7, each arm 32 of the shield 26 has an upper wall 84, a bottom wall 86 and two side walls 88 which define a hollow interior 90 and define a rectangular cross-sectional configuration. As best illustrated in FIG. 8, each of the arms 32 of the shield 26 extends from the central portion 30 of the shield 26 in a direction opposite the direction of the legs 34 of the shield 26. As best shown in FIG. 8, the length L of each of the arms 34 of the shield 26 is identical. Similarly, the length LL of each of the legs 32 of the shield is identical. However, the length L of the arms 34 is greater than the length L of the legs 32 of the shield 26.

As seen in the drawings, the top 36 of the shield 26 has an opening 92 cut out therefrom. The opening 92 is covered with a removable cover 94 to allow access to the interior 41 of the shield 26 for purposes of replacing or repairing portions of the marine engine 24.

The shield 26 of the jet pump assembly 10 may be constructed of aluminum, fiberglass and/or composite. For example, certain components of the shield 26 of jet pump assembly 10 may be constructed of cast aluminum. It will be appreciated that the shield 26 of the jet pump assembly 10 may be constructed of any suitable material which is waterproof.

Figure 2:
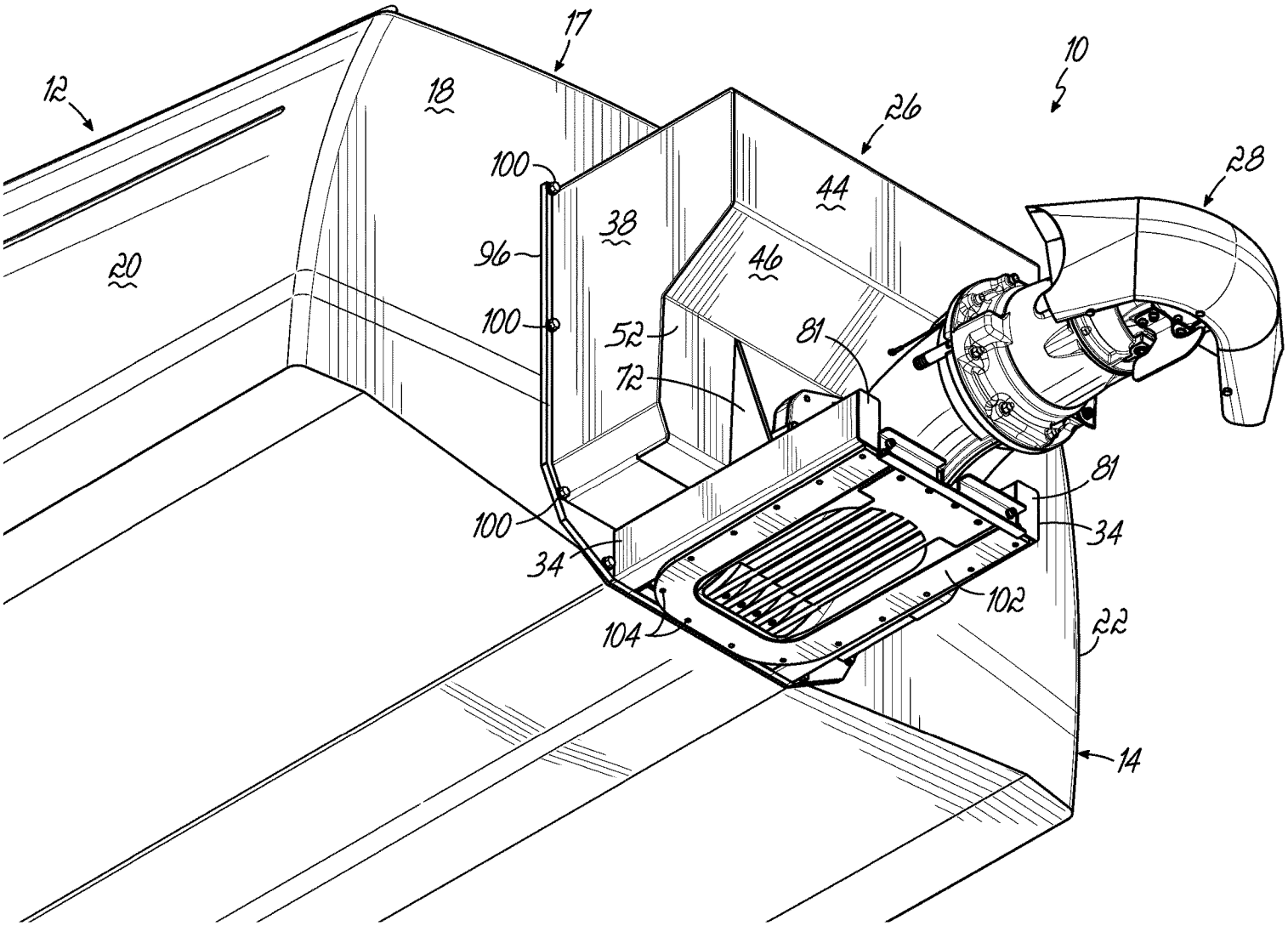
FIG. 2 is a magnified bottom perspective view of a portion of the jet pump assembly of FIG. 1, showing the shield of the jet pump assembly secured to the transom of the watercraft.

As best shown in FIG. 6, the shield 26 of the jet pump assembly 10 has a flange 96 extending around its perimeter. More particularly, the flange 96 extends upwardly from the top 36 of the shield 26, outwardly from the sides 34 of the shield 26 and downwardly from the bottom 40 of the shield 26. Holes 98 are formed through the flange 96 at select spaced locations and sized to allow bolts 100 to pass therethrough. As best shown in FIG. 2, the bolts 100 extend through the holes 98 in the flange 96 of the shield 26, through openings 116 in the gasket 114, through openings 118 in the transom 18 of the watercraft 12 and are tightened using nuts 120 with washers 122 between the nuts 120 and bolts 100 to secure the jet pump assembly 10 to the watercraft 12.

As shown in FIG. 2, when the jet pump assembly is fully assembled, the jet drive 28 is secured to the two legs 34 of the shield 28. More specifically, a grate 102 of the jet drive 28 is secured with fasteners 104 to the bottom walls 76 of the legs 34 of the shield 28. However, any other portion(s) of any known jet drive may be secured to the legs 34 of the shield 28 to secure the jet drive 28 to the shield.

Figure 9:
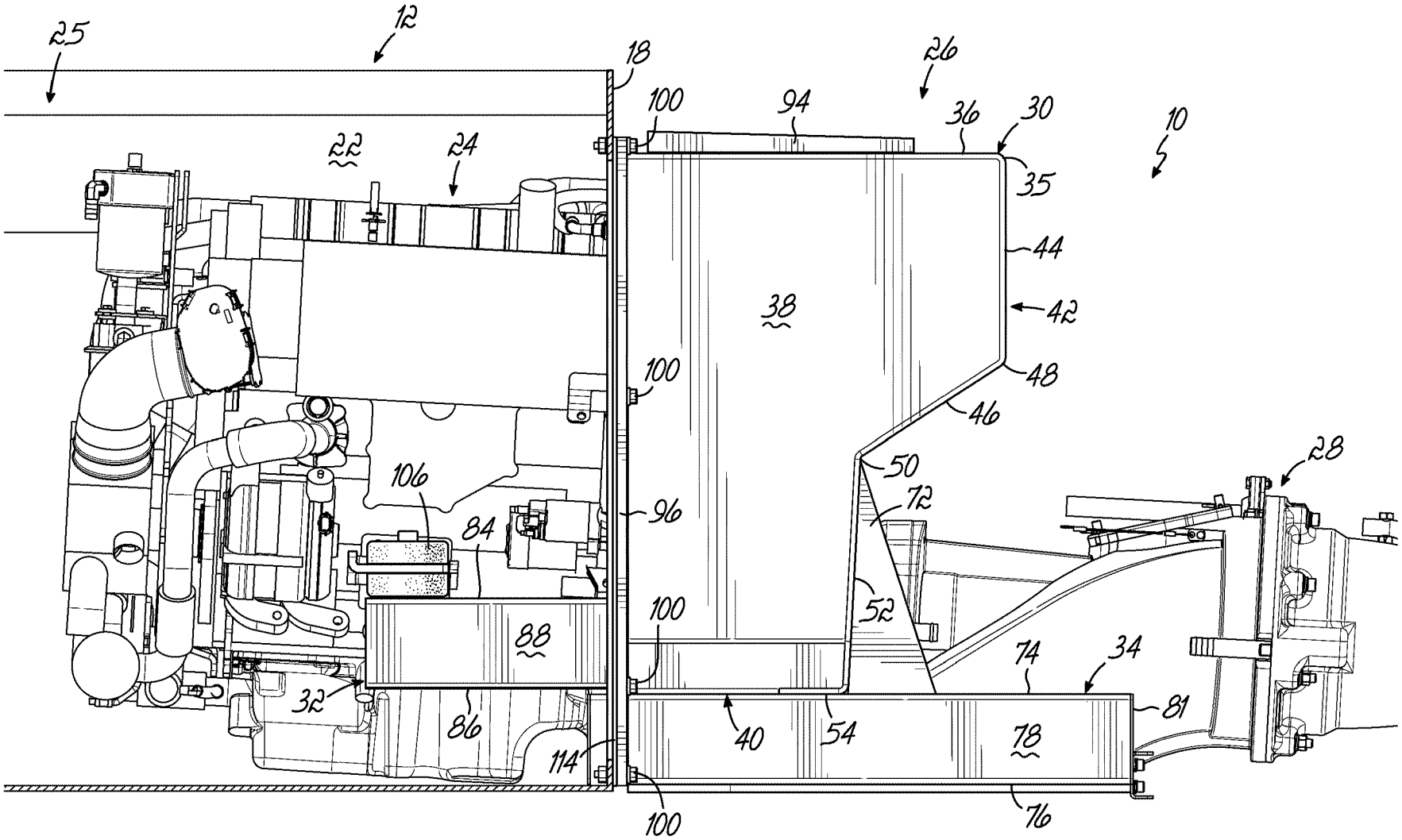
FIG. 9 is a side view of the jet pump assembly secured to the transom of the watercraft.

As shown in FIG. 9, when the jet pump assembly is fully assembled, the marine engine 24 is secured to the two arms 32 of the shield 28. More specifically, the marine engine 24 is secured with bushings (only one shown) 106 to the arms 32 of the shield 28. However, any other portion(s) of any known marine engine may be secured to the arms 32 of the shield 28 to secure the jet drive 28 to the shield 28.

Figure 5A:
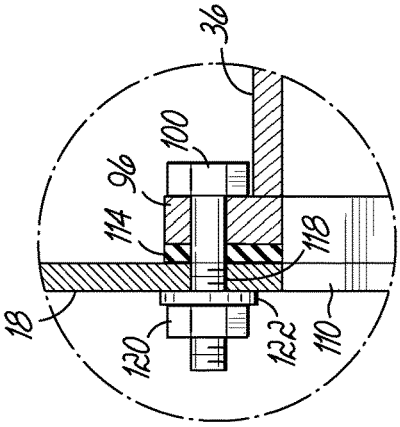
FIG. 5A is an enlarged view of the encircled area 5A of FIG. 5, showing a gasket sandwiched between the shield and the transom of the watercraft.
Figure 5:
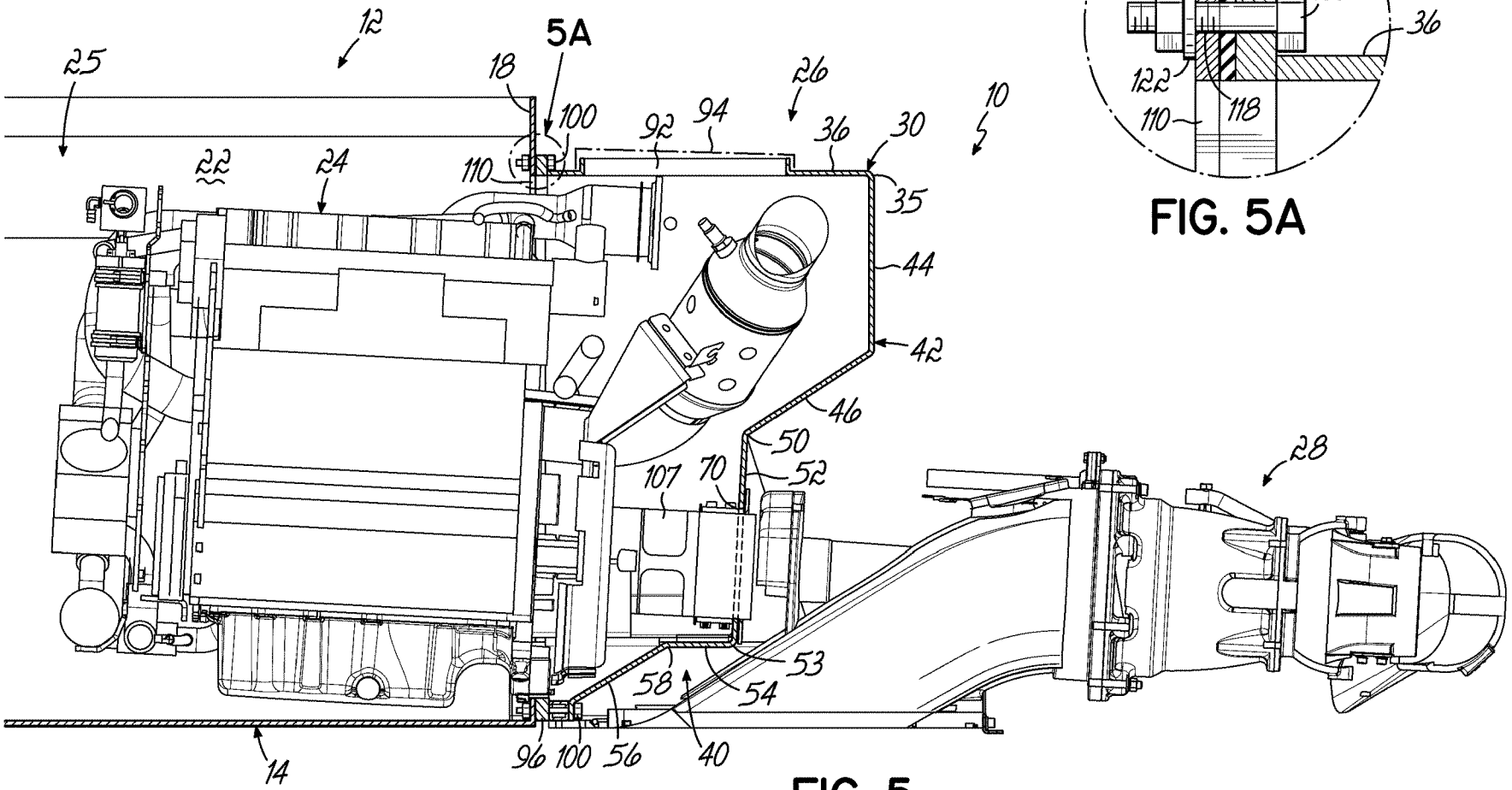
FIG. 5 is a side view showing the jet pump assembly secured to the transom of the watercraft.

Referring now to FIGS. 4-5, a method of constructing a jet pump assembly and installing the jet pump assembly 10 onto the transom 18 of the watercraft 12 is provided. Initially, as shown in FIG. 4, the jet drive 28 is secured to the shield 26 and more specifically to the two parallel legs 34 of the shield 26. The marine engine 24 is secured to two parallel arms 32 of the shield 26. Additionally, as shown in FIG. 5, a drive shaft 108 of the jet drive 28 is passed through circular opening 70 in the shield 26 and coupled to the marine engine 24 to provide power to the jet drive 28 upon operation.

Figure 4A:
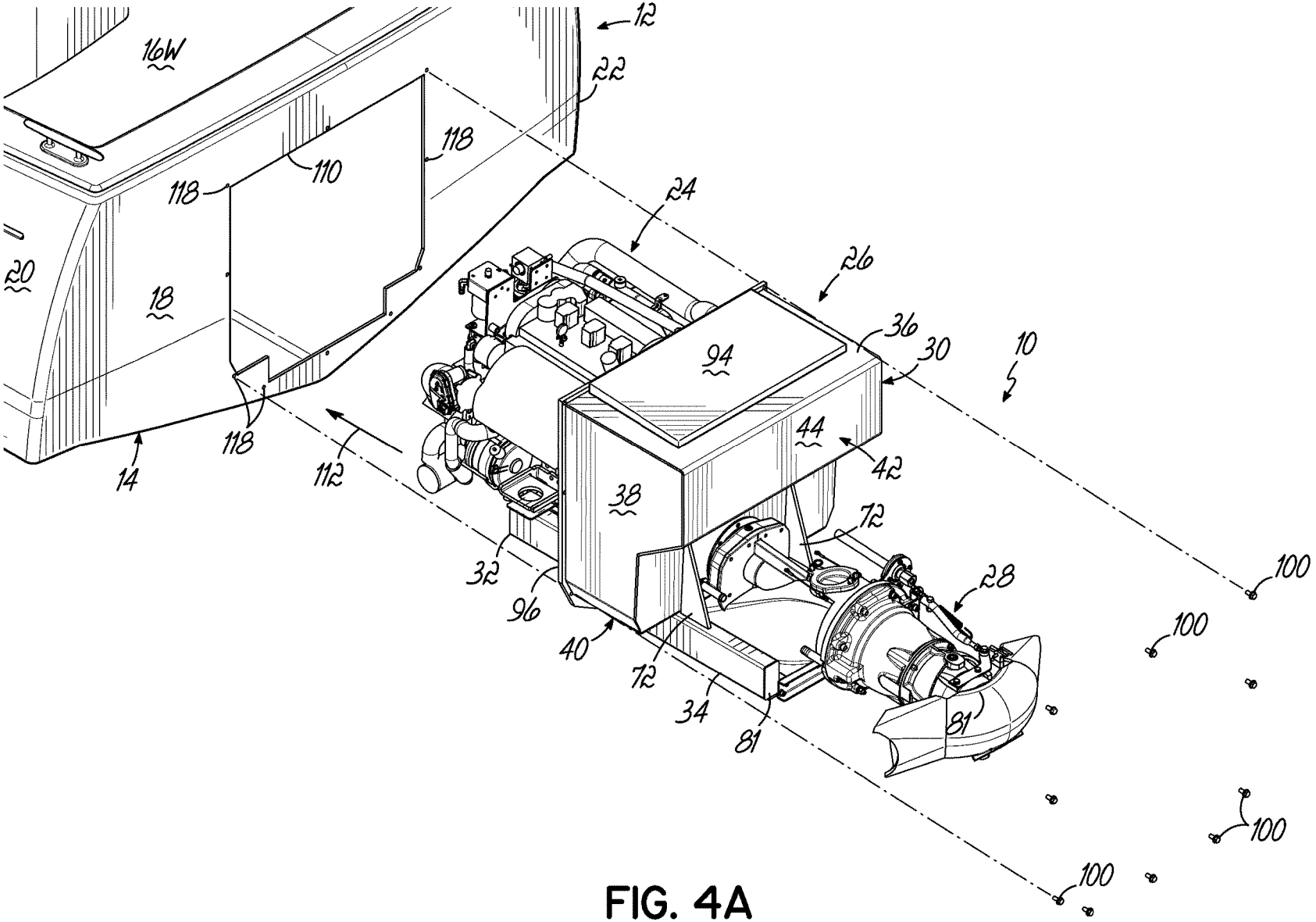
FIG. 4A is a perspective view of the assembled jet pump assembly prior to the shield of the jet pump assembly being secured to the transom of the watercraft.

After the jet pump assembly 10 is fully assembled, the assembled jet pump assembly 10 is passed partially through an opening 110 in the transom 18 of the hull 14 of the watercraft 12. See FIG. 4A. As shown in FIG. 4A, the assembled jet pump assembly 10 is oriented as shown and moved in the direction of arrow 112 such that a portion of the marine engine 24 extends through the opening 110 in the transom 18 of the hull 14 of the watercraft 12. The opening 110 is cut out of the transom 18 of the hull 14 of the watercraft 12 prior to installation of the jet pump assembly 10. The opening 110 is large enough to enable at least a portion of the marine engine 24 of the assembled jet pump assembly 10 to pass therethrough. The assembled jet pump assembly 10 does not need to be lifted over the transom 18 for assembly. In addition, the presence of the opening 110 enables the jet pump assembly 10 to be constructed prior to securement to the hull 14 of the watercraft 12.

As shown in FIG. 4A, the assembled jet pump assembly 10 is moved towards the bow of the watercraft or forwardly in the direction of arrow 112 such that a portion of the marine engine 24 extends through the opening 110 in the transom 18 of the hull 14 of the watercraft 12. The assembled jet pump assembly 10 is moved further forwardly until a gasket 114 is sandwiched between the transom 18 of the hull 14 of the watercraft 12 and the flange 96 of the shield 26 contacts the exterior surface of the transom 18 of the hull 14 of the watercraft 12. As shown in FIGS. 5 and 5A, the gasket 114 sandwiched between the transom 18 of the watercraft 12 and the flange 96 of the shield 26 prevents water from leaking inside the shield 26 and into the watercraft 12.

As shown in FIGS. 5 and 5A, after the assembled jet pump assembly 10 is properly located with the shield 26 covering the opening 110 in the transom 18 of the watercraft 12, fasteners 100 are passed through the openings 98 in the flange 96 of the shield 26, through openings 118 in the gasket 114 and through openings 118 in the transom 18 of the watercraft 12.

The fasteners 100 pass through washers 122 and nuts 120 are threaded onto the fasteners 100.

Although the drawings show one size and shape of opening 110 in the transom 18 of the hull 14, the drawings are not intended to be limiting.

The opening 110 in the transom 18 of the hull 14 may be any desired shape such that the opening 110 allows at least a portion of the marine engine 24 of the assembled jet pump assembly 10 to fit through the opening 110 in the transom 18 of the watercraft 12.

Figure 10:
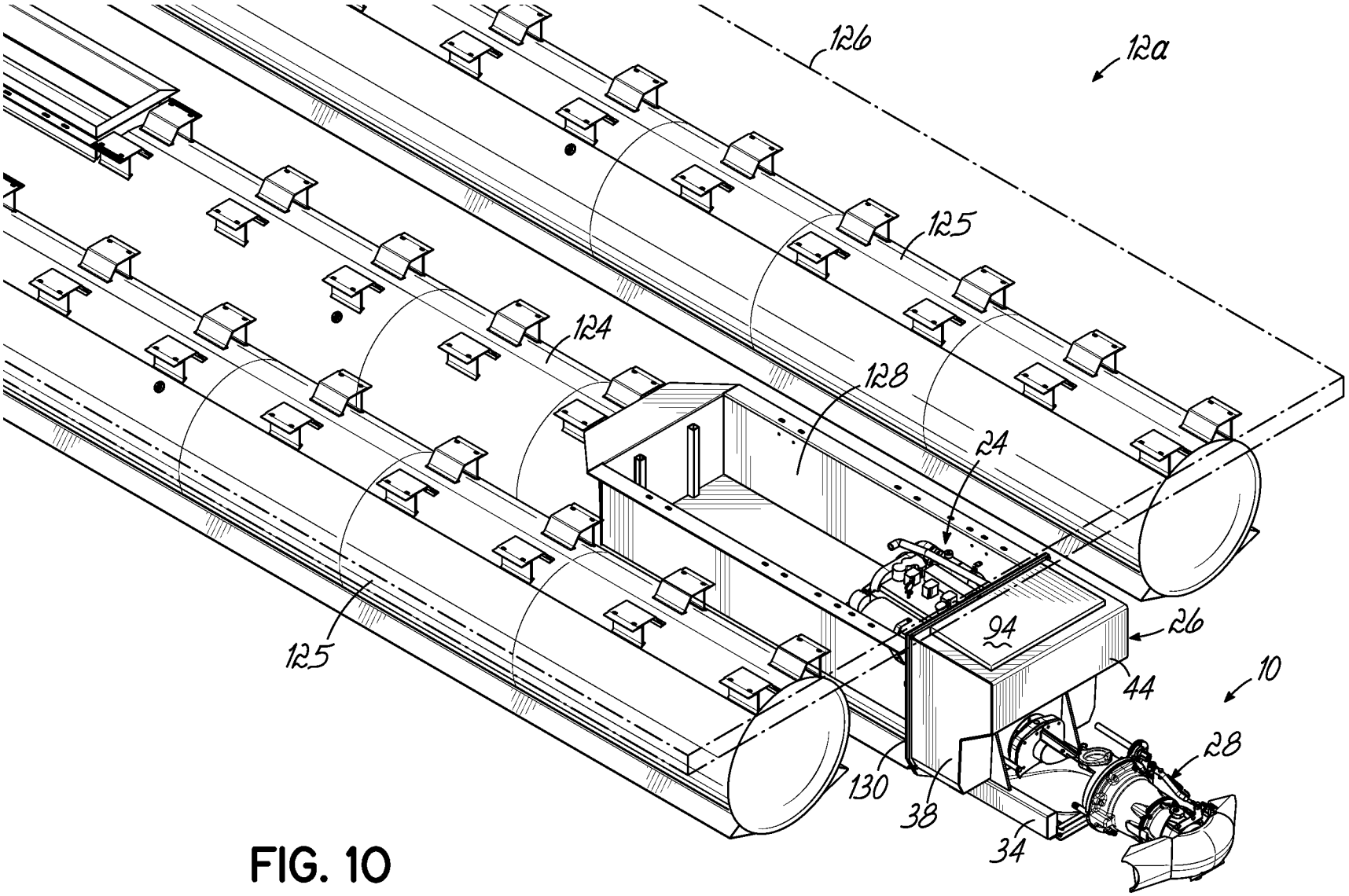
FIG. 10 is a perspective view of a portion of a pontoon boat having three pontoons, the middle pontoon having a jet pump assembly installed according to a method disclosed herein.
Figure 11:
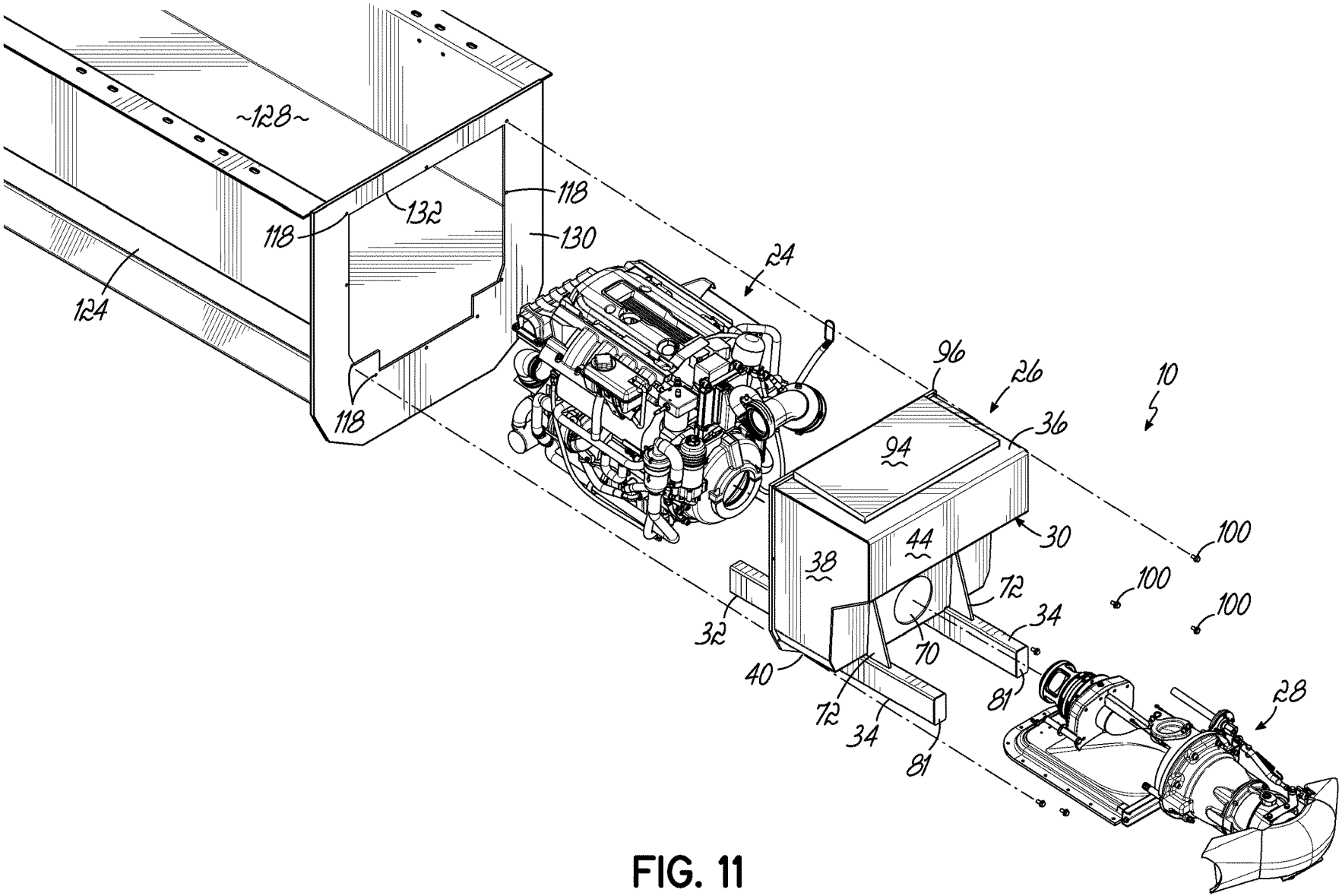
FIG. 11 is a perspective view of the jet pump assembly being put into the middle pontoon of the pontoon boat of FIG. 10.

FIGS. 10 and 11 illustrate one type of watercraft in the form of a tritoon boat 12 a. As shown in FIG. 10, the tritoon boat 12 a has two outer pontoons 125 (aka "toons") and a middle pontoon 124. A deck 126 may be secured to some or all three of the pontoons 124, 125 in any known manner. Although one type of outer pontoon 125 is illustrated, any known outer pontoon may be used. The drawings are not intended to be limiting. Similarly, although one type of middle pontoon 124 is illustrated, any known middle pontoon may be used. The drawings are not intended to be limiting. The deck 126 is shown generally and not intended to be limited in any way. Any known deck 126 may be used.

Middle pontoon 124 has a cavity 128 adapted to receive a gasoline tank (not shown) at the rear thereof. As shown in FIG. 11, the cavity 128 has a transom 130 in which an opening 132 is formed (like opening 110 formed in the transom 18 of watercraft 12 shown in FIG. 4). A jet pump assembly 10 is attached to the middle pontoon 124 through the opening 132 in the transom 130 of middle pontoon 124 in the same manner described above.

Although FIGS. 10 and 11 illustrate a tritoon watercraft 12 a, the present invention may be used to manufacture a pontoon watercraft as well. Any watercraft incorporating floats or pontoons may have a jet pump assembly as described and shown herein. The jet pump assembly or assemblies may be installed in any such watercraft in accordance with any of the methods described and/or shown herein.

Figure 3:
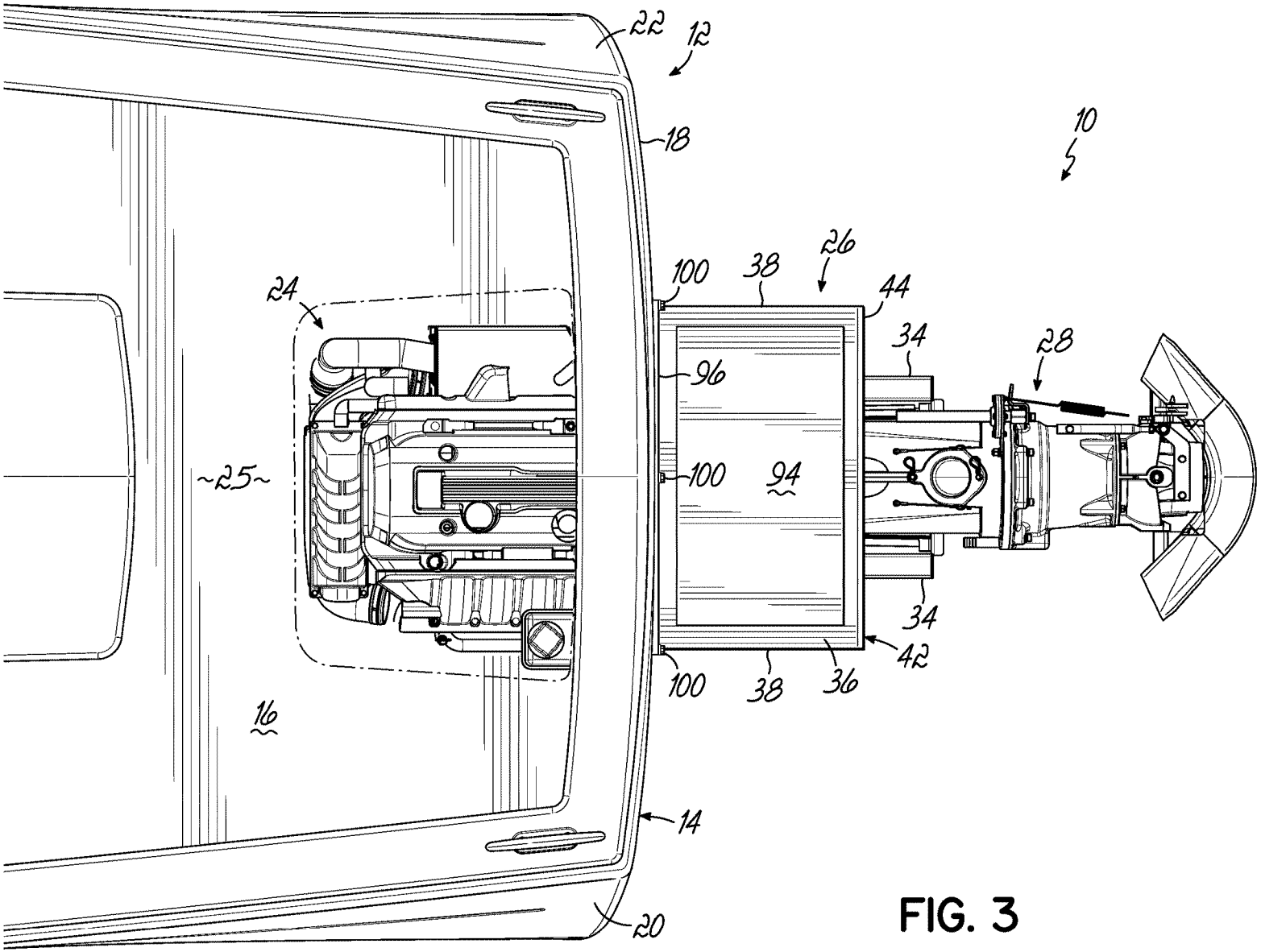
FIG. 3 is a top view of the jet pump assembly secured to the transom of the watercraft.

Accordingly, complete installation of the jet pump assembly 10 may be accomplished in a relatively short time as compared to conventional installation techniques. Moreover, by assembling the jet pump assembly 10 prior to securement to the transom 18 of the hull 14 of the watercraft 12, many of the difficulties associated with the current method of securing a jet pump to a watercraft are avoided. The jet pump assembly 10 may be assembled more easily and more quickly than the current method of assembling a portion of the jet pump assembly inside the watercraft including one having pontoons. As shown in FIGS. 1 and 3 when fully installed the marine engine 24 inside the interior 25 of the watercraft 12 may be covered with a cover shown in dashed lines for safety.

Figure 12:
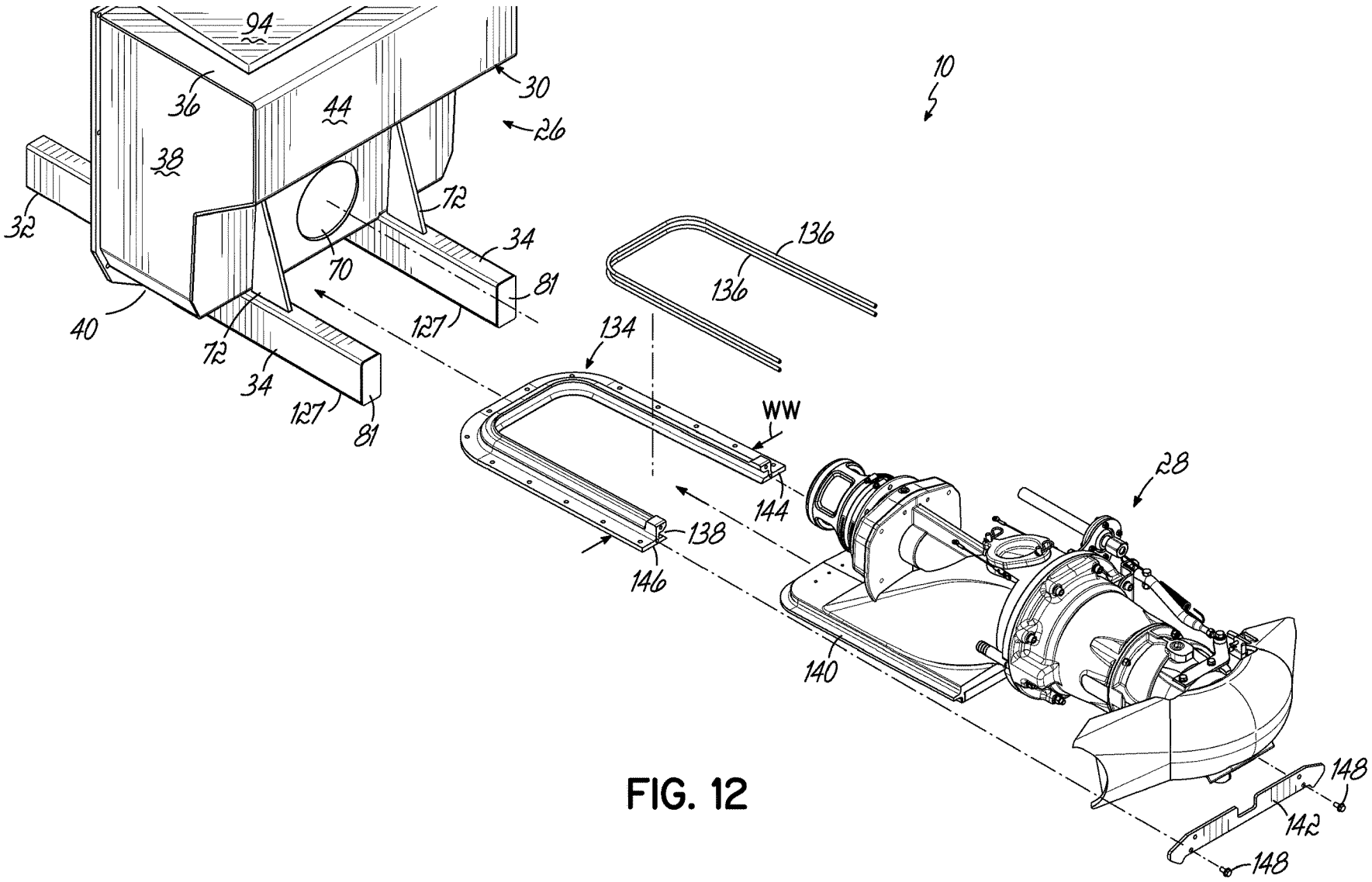
FIG. 12 is an enlarged disassembled view of a portion of the jet pump assembly of FIG. 11.

FIG. 12 shows the details of how the jet drive 28 is secured to the shield 26. More particularly, FIG. 12 shows how the jet drive 28 is secured to the two legs 34 extending rearwardly from the central portion 30 of the shield 26. A U-shaped or horseshoe-shaped intake mount 134 is secured to the lower surfaces 127 of the legs 34 of the shield 26. It is within the scope of the present application that the legs 34 of the shield 26 may have grooves or some other structure built therein which may receive and retain the intake mount 134 in a cost effective structurally sound manner.

As fully disclosed in pending U.S. patent application Ser. No. 17/144,519, which is fully incorporated by reference herein, two vibration insulators 136 are located inside a groove 138 in the intake mount 134 with a flange 140 of the jet drive 28 therebetween to reduce the vibration from the jet drive 28. See FIGS. 13 and 15 of U.S. Pat. Publication No. US 2021/0147055 which is the publication of U.S. patent application Ser. No. 17/144,519 and fully incorporated by reference herein. It will also be appreciated that a single vibration insulator may be used in place of the two vibration insulators 136.

Although one configuration of jet drive 28 is illustrated, the drawings of this document are not intended to limit the configuration of jet drive 28. Similarly, the jet drive 28 is not intended to be limited to the jet drives disclosed in U.S. patent application Ser. No. 17/144,519, published as U.S. Pat. Publication No. US 2021/0147055 or those disclosed in U.S. Pat. Nos. 10,486,786 and 10,787,237.

A retention plate 142 is fixedly coupled to the first and second ends 144, 146 of the intake mount 134, such as via fasteners 148, to prevent the jet drive 28 from sliding free from the intake mount 134. Although one configuration on retention plate 142 is shown, any other shape or size of retention plate 142 may be used.

Figure 13:
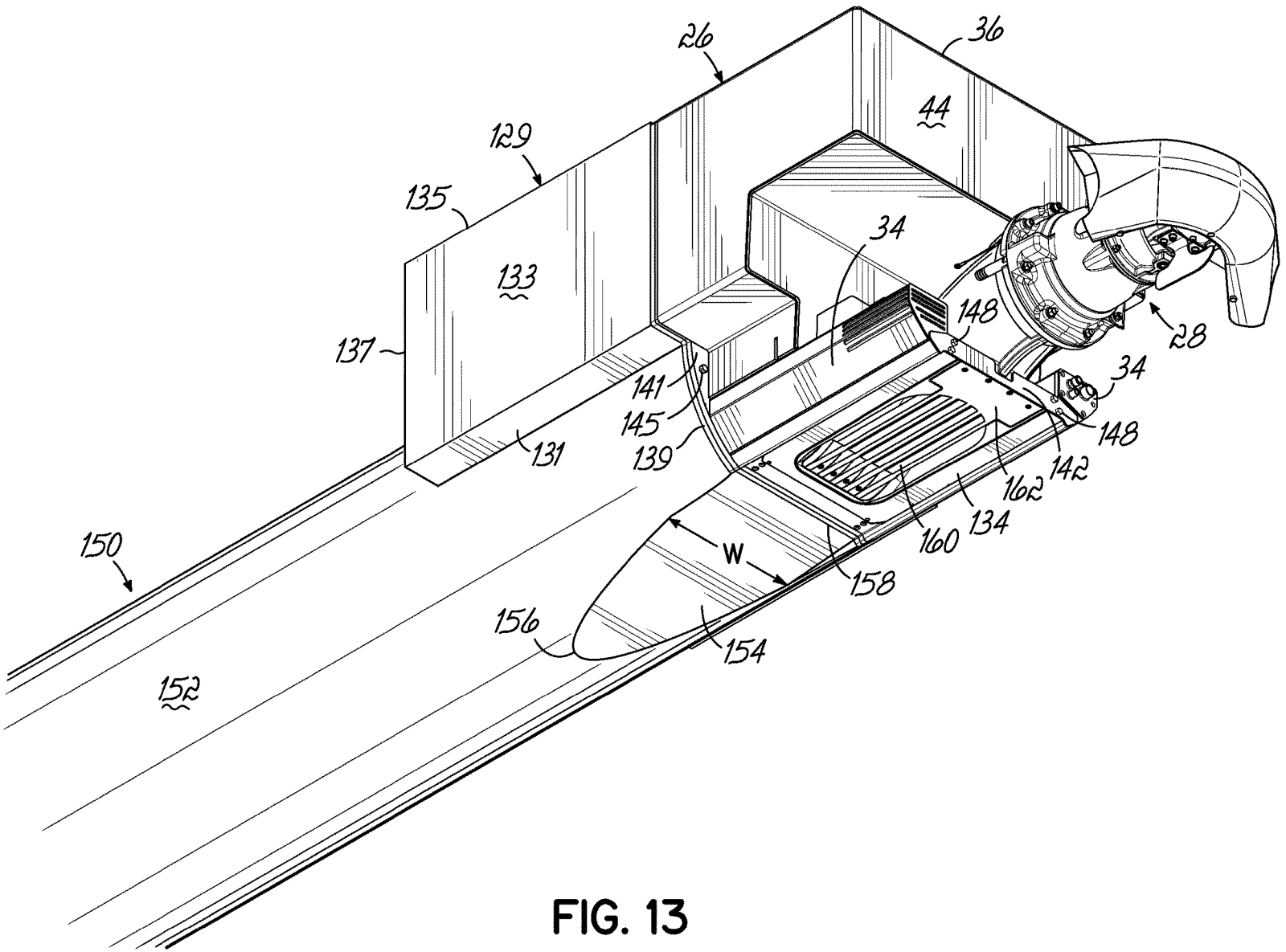
FIG. 13 is a bottom perspective view of the jet pump assembly secured to a middle pontoon of a pontoon boat.
Figure 14:
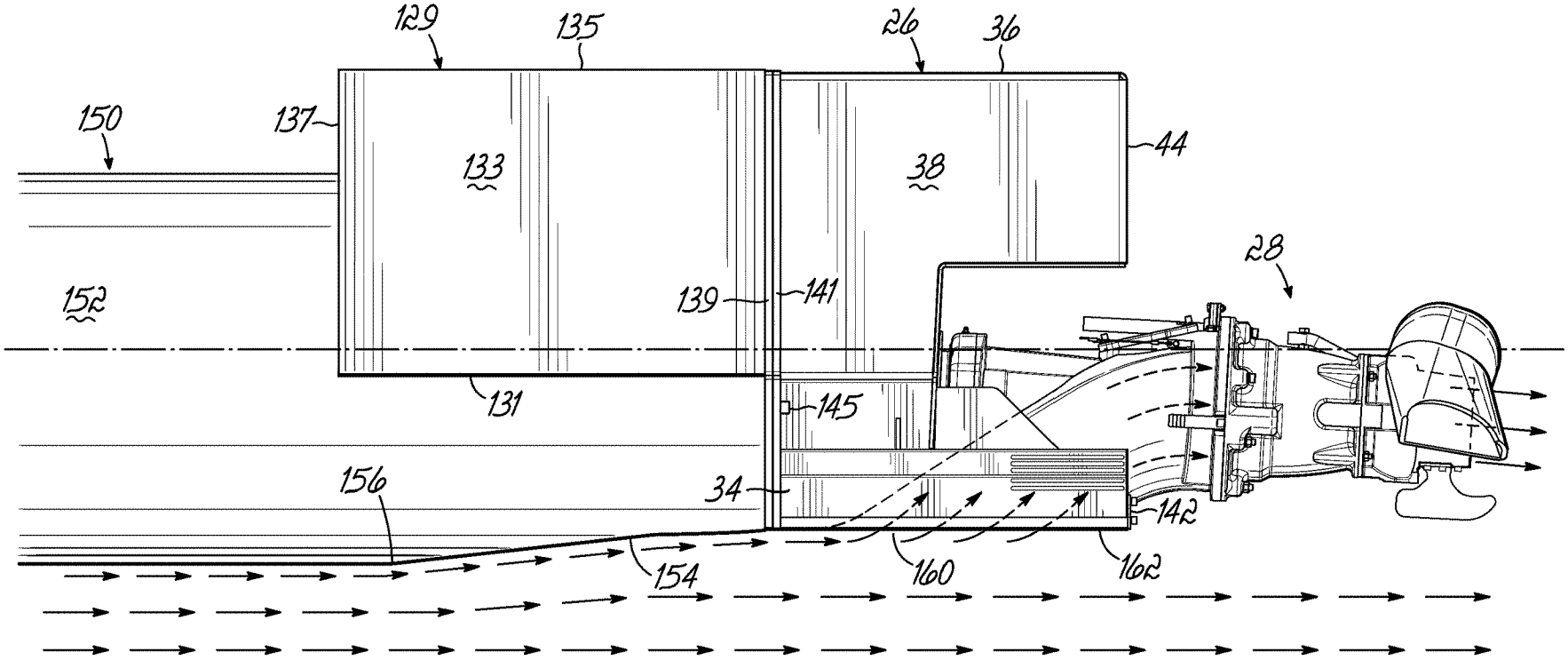
FIG. 14 is a side view of the jet pump assembly of FIG. 12 secured to the back of the middle pontoon of FIG. 13.

FIGS. 13 and 14 disclose another innovative feature of the present invention. FIGS. 13 and 14 show a middle pontoon 150 of a pontoon boat like the pontoon boat 12 a shown in FIG. 10. However, the middle pontoon 150 may be used in any pontoon boat including those known in the art. The middle pontoon 150 has a generally rectangular cavity 129, like generally rectangular cavity 128 shown in FIG. 10, but a different size. The generally rectangular cavity 129 has a bottom 131 extending on both sides of the middle pontoon 150 beyond the remainder of the middle pontoon 150 as shown in FIG. 13 (only one side of bottom 131 being shown). The generally rectangular cavity 129 also has sides 133 (only one being shown in FIG. 13) extending upwardly from the bottom 131 of the generally rectangular cavity 129, each side 133 having an upper edge 135. The generally rectangular cavity 129 also has a back wall 137 and an open top (not shown) like the cavity 128 shown in FIG. 10.

As shown in FIGS. 13 and 14, the top 36 of the shield 26 is aligned with the upper edges 135 of sides 133 when the shield 26 is secured to the middle pontoon 150. The shield 26 may be secured to the middle pontoon 150 with fasteners 145 (only one being shown) joining one or more flanges 139 of the middle pontoon 150 to one or more flanges 141 of the shield 26. The flanges 139 of the middle pontoon 150 may be outwardly or inwardly directed or a combination thereof. Similarly, the flanges 141 of the shield 26 may be outwardly or inwardly directed or a combination thereof. If the flanges of the middle pontoon 150 and shield 26, respectively, are continuous flanges, they may be inwardly or outwardly directed. The drawings are not intended to be limiting.

The middle pontoon 150 has a curved outer surface 152 along the bottom thereof except for a ramp 154 which is generally planar or flat. The ramp 154 is narrower on its upstream end 156 than its downstream end 158. The width "W" of the ramp 154 at its downstream end 158 is approximately equal to the width "WW" of the intake mount 134. See FIG. 12. The ramp 154 leads into a water intake 160 of the jet drive 28.

As shown in FIG. 14, the ramp 154 is higher on its downstream end 158 that on its upstream end 156. Such a configuration serves to direct water upwardly into the water inlet 160 of the jet drive 28 when the middle pontoon 150 is moving. The water inlet 160 of the jet drive 28 is covered by an intake grate 162 to prevent debris from entering the water intake 160. The arrows shown in FIG. 14 show the flow of water when the middle pontoon 150 of a pontoon boat is moving through the water or in motion. While the middle pontoon 150 is in motion, the configuration, shape and size of the ramp 154 ensures that water, rather than air, enters the water intake 160 of the jet drive 28. The size or shape of ramp 154 is not intended to be limited by the drawings. The ramp 154 may be other sizes or shapes.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A jet pump assembly for attachment to a middle pontoon of a pontoon boat, the jet pump assembly comprising:

a marine engine;

a jet drive including a rotatable shaft configured to receive torque from the marine engine; and a shield adapted to be secured to the middle pontoon of the pontoon boat, wherein the shield has parallel arms to which the marine engine is secured and parallel legs to which an intake mount is secured, the jet drive being secured to the intake mount, the arms and legs of the shield extending in opposite directions, wherein the rotatable shaft extends through an opening in the shield.

2. The jet pump assembly of claim 1, wherein the middle pontoon of the pontoon boat has a ramp to direct water into a water inlet of the jet drive.

3. The jet pump assembly of claim 2, wherein the intake mount is generally U-shaped.

4. The jet pump assembly of claim 1, wherein the middle pontoon of the pontoon boat has a rectangular cavity sized to receive and retain the marine engine.

5. The jet pump assembly of claim 1, wherein the shield is large enough to cover an opening in the middle pontoon of the pontoon boat, the opening in the middle pontoon of the pontoon boat being large enough so the marine engine may pass through the opening in the middle pontoon of the pontoon boat.

6. The jet pump assembly of claim 1, wherein the shield has a removable cover.

7. The jet pump assembly of claim 1, wherein the shield has a flange which has openings through which fasteners extend to secure the shield to the middle pontoon of the pontoon boat.

8. In combination, a pontoon boat and a jet pump assembly, the combination comprising:

a pontoon boat having a middle pontoon with an opening therein, a jet pump assembly comprising:

a marine engine;

a jet drive including a rotatable shaft configured to receive torque from the marine engine; and a shield secured to the middle pontoon of the pontoon boat, the shield having two hollow parallel legs by which the jet drive is supported and two hollow parallel arms to which the marine engine is supported, wherein the rotatable shaft extends through an opening in the shield and the shield covers an opening in the middle pontoon of the pontoon boat.

9. The combination of claim 8, wherein the shield has a flange coupled to an exterior surface of the middle pontoon of the watercraft and a gasket is located between the flange and the exterior surface of the middle pontoon of the pontoon boat.

10. The combination of claim 8, wherein the shield has an interior cavity and a portion of the marine engine is located inside the interior cavity of the shield.

11. The combination of claim 8, wherein an intake mount is secured to the hollow parallel legs of the shield.

12. A method of installing a jet pump assembly to a middle pontoon of a pontoon boat, the method comprising:

securing a jet drive and a marine engine to a shield;

passing the marine engine at least partially through an opening in the middle pontoon of the pontoon boat; and securing a flange of the shield to the middle pontoon of the pontoon boat.

13. The method of claim 12, further comprising:

sandwiching a gasket between the flange of the shield and the middle pontoon of the pontoon boat.

14. The method of claim 12, wherein securing the jet drive to the shield comprises securing the jet drive to an intake mount secured to two hollow parallel legs of the shield.

15. The method of claim 12, wherein securing the marine engine to the shield comprises securing the marine engine to two hollow parallel arms of the shield.

16. A method of installing a jet pump assembly to a middle pontoon of the pontoon boat, the method comprising:

building a jet pump assembly by securing an intake mount and a marine engine to a shield and securing a jet drive to the intake mount, the shield having an opening through which a portion of the jet drive extends, the marine engine being coupled to the jet drive to power the jet drive;

passing a portion of the jet pump assembly through an opening in a middle pontoon of the watercraft; and securing the shield to the middle pontoon of the pontoon boat.

17. The method of claim 16, wherein securing the shield to the middle pontoon of the pontoon boat comprises securing a flange of the shield to the middle pontoon of the pontoon boat.

18. The method of claim 17, further comprising securing a gasket between the flange of the shield and the middle pontoon of the pontoon boat.

19. The method of claim 16, wherein securing the intake mount to the shield comprises securing the intake mount to two hollow parallel legs of the shield.

20. The method of claim 16, wherein passing a portion of the jet pump assembly through the opening in the middle pontoon of the pontoon boat comprising passing at least a portion of the marine engine through the opening in the middle pontoon of the pontoon boat.

* * * * *